United States Patent [19]

Maruyama

[11] Patent Number: 4,952,084

[45] Date of Patent: Aug. 28, 1990

[54] HEAD POSITION CONTROLLER FOR THERMAL PRINTER

[75] Inventor: Takahito Maruyama, Takizawa, Japan

[73] Assignee: Alps Electric Co., Ltd., Tokyo, Japan

[21] Appl. No.: 187,260

[22] Filed: Apr. 28, 1988

[30] Foreign Application Priority Data

Aug. 6, 1987 [JP] Japan ..... 62-195242

[51] Int. Cl.[5] ..... B41J 3/20

[52] U.S. Cl. ..... 400/120; 400/229; 400/185

[58] Field of Search ..... 400/356, 120, 120, 185, 400/187, 225, 229, 231, 232, 356

[56] References Cited

U.S. PATENT DOCUMENTS

| | | | |
|---|---|---|---|
| 3,855,448 | 12/1974 | Hanagata et al. | 400/120 |
| 4,586,837 | 5/1986 | Johnson et al. | 400/216.2 |
| 4,644,371 | 2/1987 | Matsuura et al. | 400/356 |
| 4,707,154 | 11/1987 | Arai | 400/185 |
| 4,709,242 | 11/1987 | Uchikata et al. | 400/231 |

FOREIGN PATENT DOCUMENTS

| | | | |
|---|---|---|---|
| 43581 | 3/1986 | Japan | 400/356 |

*Primary Examiner*—David A. Wiecking

*Attorney, Agent, or Firm*—Guy W. Shoup; Paul J. Winters

[57] ABSTRACT

A head position controller for a thermal printer which includes a thermal head, a platen, and a carriage which is supported for movement relative to the platen by a motor. The controller includes a head contacting plate, and a motor driven cam which engages the contacting plate to move the thermal head relative to the platen. The cam has a curve which is configured to selectively move the thermal head with respect to the platen from separating to contacting positions, a cam lever having a cam follower which is movable along the cam curve, the lever being connected to the head pressure contacting plate for movement only at a predetermined angle. The controller also includes a heart cam which defines rotation of the cam lever with the cam curve, the heart cam engaging another cam follower which projects from the contacting plate, and an intermittent moving mechanism which transmits intermittent movement to the carriage.

3 Claims, 5 Drawing Sheets

HEAD POSITION CONTROLLER FOR THERMAL PRINTER

BACKGROUND OF THE INVENTION

1. Field of the Invention

This invention relates to a thermal printer for selectively energizing a plurality of heat generators aligned in a thermal head to melt the ink of an ink ribbon and transfer it to a sheet of paper. More particularly, this invention relates to a head position controller for a thermal printer for controlling the contact or separation of a thermal head with or from the paper.

2. Description of the Prior Art

In a thermal printer a carriage moving along a platen is generally provided. A thermal head is mounted on a head mount which is movably connected to the carriage A head pressure contacting lever for thrusting the thermal head against a sheet of paper by pressing the head mount is pivotally secured to the carriage. The head mount is pressed by pressing the head contacting lever with a head pressure contacting plate. The movements of the carriage and the contact or separation of the thermal head with or from the paper are carried out by one electric motor.

In the above-described thermal head, an ink ribbon is fed to the thermal head at a rate equal to the rate of travel of the carriage across the surface of the paper while printing. Printing is produced by contacting the ink ribbon with the thermal head by interposing the ink ribbon and the paper between the thermal head and the platen in order to transfer the ink of the ink ribbon to a predetermined position on the paper.

However, when the ink ribbon is continuously fed in this manner to print on the paper, the ink ribbon must be fed even when there is a gap between printed characters, e.g. a space between words. Further, the ink ribbon, once fed in front of the thermal heads has a number of vacant portions from which the ink has been transferred to the sheet of paper. The previously used portion can not be reused Therefore, the portion of the ink ribbon opposed to a gap in the characters which could be reused is wasted because the printer cannot rewind to use this portion.

Thus, when a large space exists in the printed image information it is advantageous to detect the space, separate the thermal head from the ink ribbon, and stop the feeding of the ink ribbon. This state is called the "tape saving mode".

However, a solenoid is used to contact or separate the thermal head with or from the ink ribbon, thereby switching between the tape saving mode and the printing mode. Thus, the structure of the thermal printer is complicated and expensive to produce.

SUMMARY OF THE INVENTION

Accordingly, an object of this invention is to provide a head position controller for a thermal printer which can eliminate the above-mentioned drawbacks of the conventional thermal printer and in which tape saving can be carried out by a simple construction which can be inexpensively produced.

In order to eliminate the above-mentioned drawbacks, there is provided a head position controller for a thermal printer of the type which includes a thermal head, a platen and carriage which is supported for movement along the platen by a reversible motor. The controller comprises a head pressure contacting plate mounted on the carriage which moves the thermal head into and out of contact with the platen, and a cam rotated by the motor which affects movement of the pressure contacting plate. The cam has a cam curve which is shaped to selectively move the thermal head with respect to the platen from a separating position to a contacting position. The thermal controller also includes a cam lever having a cam follower which is moveable along the cam curve upon rotation of the cam, the lever being connected to the head pressure contacting plate for movement only at a predetermined angle. A heart cam provided to define the rotation of the cam lever through the cam curve engages with another cam follower which projects from the head pressure contacting plate. An intermittent driving mechanism driven by the motor for transmitting the intermittent movement to the carriage is also included in the thermal controller.

According to this invention, the cam follower of the cam lever and the head pressure contacting plate engages with the cam which is driven in both directions by the motor The cam follower of the head pressure contacting plate is engaged with the heart cam. The motor rotates the cam in order to switch from the printing mode to the tape saving mode Thus, when the motor is driven to rotate the cam reversely under a condition in which the cam follower of the cam lever is engaged with the cam curve of the cam at the position which causes the thermal head to press against the platen, the cam follower of the cam lever moves to the position which causes the thermal head to separate from the platen Since the drive of the motor is transmitted to the carriage through an intermittent driving mechanism, the carriage is not stopped during the rotation of the cam in the above-mentioned range. When the motor is again driven, but in the opposite direction, the cam follower of the cam lever and the cam follower of the cam head pressure contacting plate engaged with the heart cam move to another position in which the thermal head is separated from the platen. This continued rotation of the motor sets the tape saving mode so that the thermal head is separated from the platen but the carriage moves in the same direction as when printing.

In order to switch the tape saving mode to the printing mode, the cam is rotated as described above, but in the reverse direction. To set the carriage return mode which separates the thermal head from the platen and returns the carriage to its initial position, the motor is continuously driven so as to rotate the cam reversely from the printing mode or the tape saving mode.

The above and other related and objects and features of the invention will become apparent from the following description, the accompanying drawings and the appended claims.

BRIEF DESCRIPTIONS OF THE DRAWINGS

DESCRIPTION OF THE PREFERRED EMBODIMENTS

Figure 1:
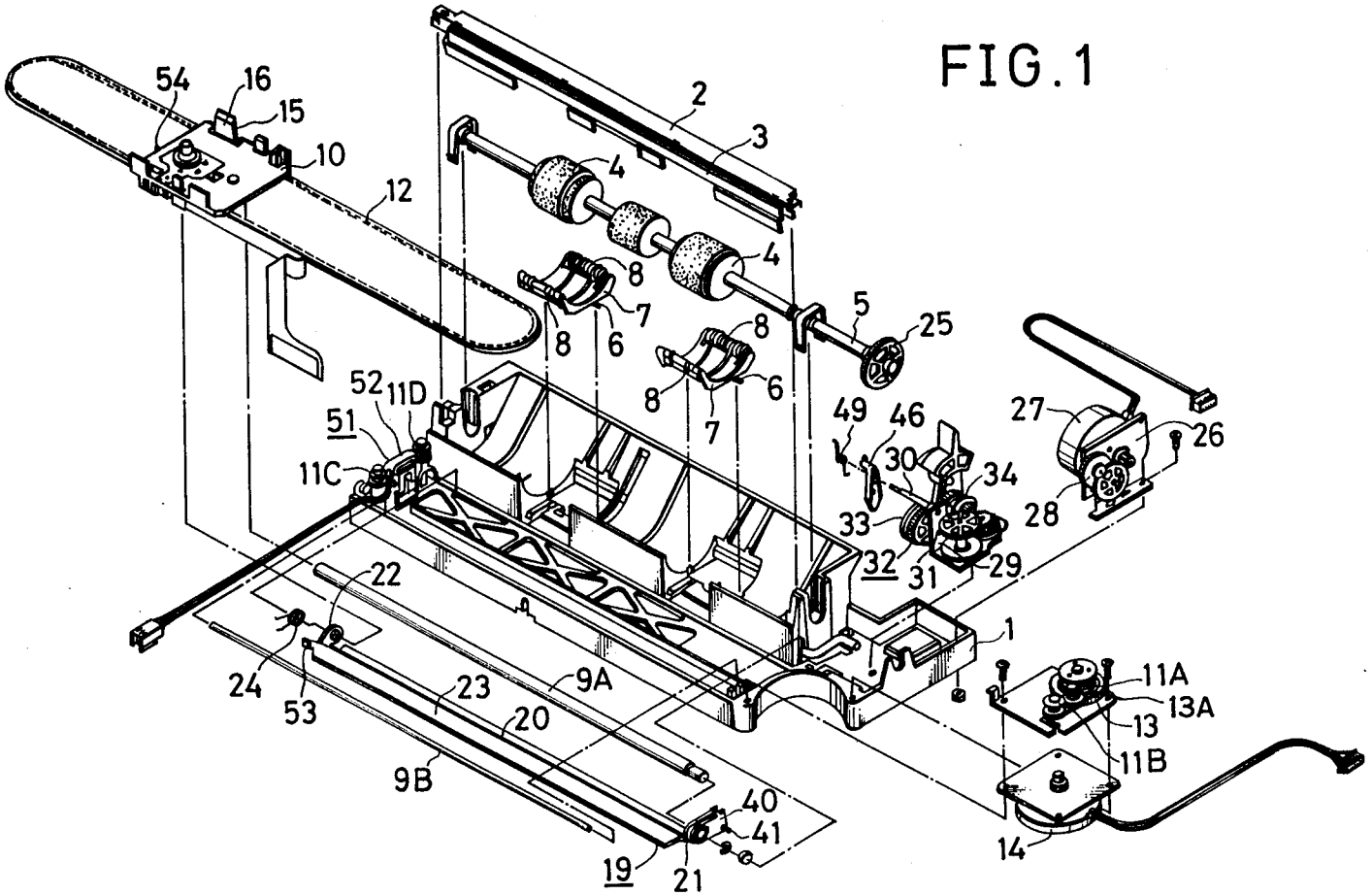
FIG. 1 is an exploded perspective view showing an embodiment of a thermal printer to which a head position controller of the present invention is applied.
Figure 2:
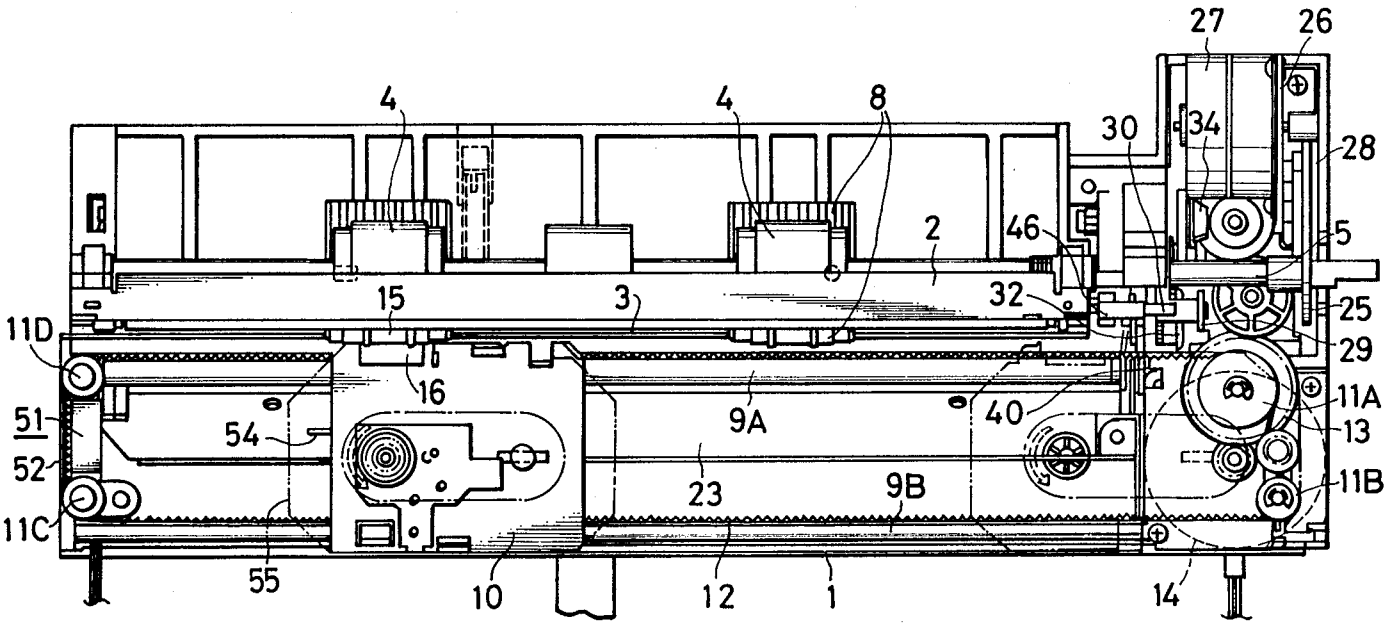
FIG. 2 is plane view of an assembly of FIG. 1.

Embodiments of the present invention will be described in detail with reference to the accompanying drawings. FIGS. 1 and 2 show a thermal printer to which a head position controller according to the present invention is applied First, the thermal printer will be generally described.

A flat platen 2 of L-shaped cross section is mounted in a casing 1 so as to extend horizontally, and a rubber plate 3 of similarly flat shape is supported to the front surface of the platen 2. A plurality of large diameter rubber conveying rollers 4, for supplying a sheet of paper, not shown, are supported on a rotational shaft 5 which is parallel to the platen 2 and in front of the rubber plate 3 Small rollers 8 in contact with the conveying rollers 4 are attached to bent brackets 7 which are rockably supported to the casing 1 and connected to supporting shaft 6. A sheet of paper, not shown, interposed between the conveying rollers 4 and the small rollers 8 is conveyed by rotating the rotational shaft 5.

Columnar guide rods 9A and 9B extending in parallel with platen 2 are attached to the casing 1 in front of platen 2, and a carriage 10 is supported to both the guide rods 9A and 9B so that it can move along the platen 2. Toothed belt wheels 11A–11D each having a vertical axis are supported on the casing 1 at both ends of the guide rods 9A and 9B A toothed belt 12 is wound on the belt wheels 11A–11D in such a manner that the intermediate portion of the belt 12 is coupled with the carriage 10. The toothed belt wheel 11A is a driving pulley, and the toothed belt wheels 11B, 11C, and 11D are follower pulleys.

The toothed belt wheel 11A is coaxially arranged with a driving gear 13 and coupled to it through an intermittent driving mechanism located at 13A in FIG. 1, corresponding to a position sandwiched between 11A and 13 in FIG. 2. The driving gear 13 is rotatably driven in both directions by a reversible motor 14. Accordingly, when the motor 14 is driven reversely to the previous rotating direction, the reverse rotation is not transmitted to the toothed belt wheel 11*a* until the driving gear 13 has been rotated a predetermined number of teeth (e.g., 80 teeth). Thus, due to the operation of the intermittent driving mechanism, the carriage 10 and the toothed belt 12 are held stationary when the motor 14 is initially driven.

Figure 3A:
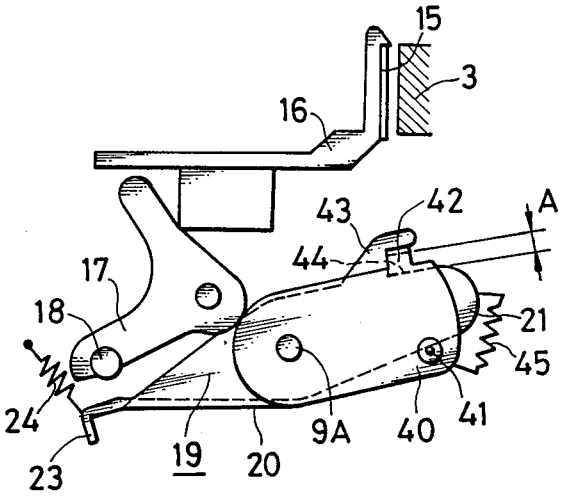
FIGS. 3A and 3B are schematic side view showing the operation of a head pressure contacting plate and a cam lever.
Figure 3B:
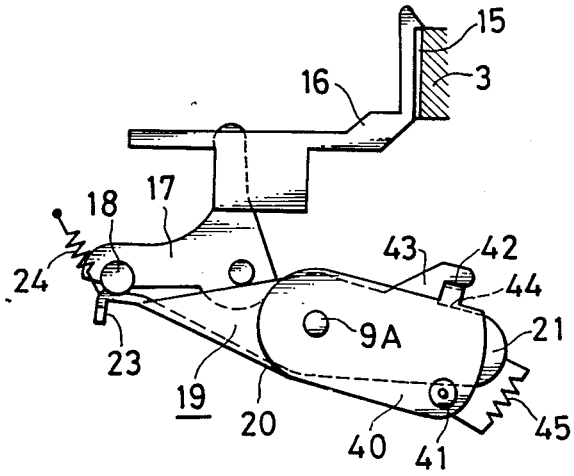

A thermal head 15 is movably mounted on the carriage 10 so that it can contact with or separate from the rubber plate 3 of the platen 2. The thermal head 15 is, as shown in FIGS. 3A and 3B, mounted on an L-shaped head mount 16 which is slidably supported on the carriage 10 and energized by a spring, not shown, away from the rubber plate 3. A head pressure contacting lever 17 for pressing the head mount 16 so as to contact the thermal head 15 with the rubber plate 3 is pivotally secured to the carriage 10. A guide roller 18 is rotatably supported to the lower side of the end of the head pressure contacting lever 17. The head pressure contacting lever 17 is separated from the head mount 16 by its own weight in a free state.

Both substantially U-shaped arms 21 and 22 of head pressure contacting plate 19 are rotatably secured by a supporting plate 20 and both arms 21 and 22 are formed integrally to respective ends of the guide rod 9A. A pressing plate 23 for rotating the head pressure contacting lever 17 is attached to the supporting plate 20 of the head pressure contacting plate 19 which extends parallel to the guide rod 9A. The pressing plate 23 forces the thermal head 15 to contact the platen 2 via the head pressure contacting lever 17. A coiled spring 24 for energizing the pressing plate 23 towards contact with the head pressure contacting lever 17 is interposed between the pressing plate 23 and the casing 1.

Turning to FIGS. 1 and 2, a gear 25 is engaged with the end of the rotational shaft 5; a bracket 26 is erected in the case 1; and an electric motor 27 is mounted on the bracket 26 A gear train 28 is interposed between the motor 27 and the gear 25 to step down the drive of the motor 27 to the gear 25. Thus, the motor 27 rotates the conveying rollers 4 in order to convey the sheet of paper.

Another bracket 29 is erected near the end of the rotational shaft 5, and a pair of supporting shafts 30 and 31 extending parallel to the guide rod 9A are supported to the bracket 29. A groove cam 32 formed with teeth 33 on the outer periphery is rotatably supported to the lower supporting shaft 31. The toothed part 33 and the driving gear 13 are engaged with the supporting shaft 31 to transmit the rotation of the motor 14 through the gear train 34.

Figure 4A:
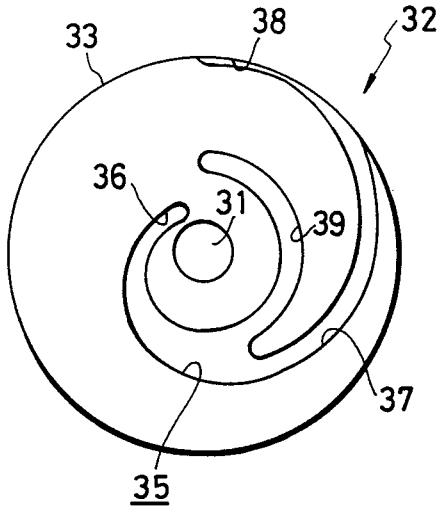
FIGS. 4A and 4B are front and developed view showing in detail the cam groove of the groove cam.
Figure 4B:
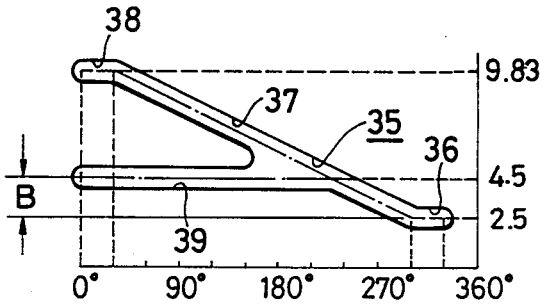

As shown in FIGS. 4A and 4B, the cam groove 35 of the groove cam 32 is formed with an inner end 36 at the center of the groove cam 32, and a main cam groove 37 with gradually increasing radius extending counter-clockwise approximately 360° from the center to the outer end 38 near the periphery of the groove cam 32. A sub cam groove 39 with constant radius extending counter-clockwise approximately 180° branches from the main cam groove 37 at the position approximately 100° from the inner end 36 such that the end of sub cam groove 39 aligns with the end of main cam groove 37. A cam follower 41 adjacent to the arm 21 of the head pressure contacting plate 19 and projected from a cam lever 40 which is pivotally secured to the guide rod 9A engages the cam groove 35.

As shown in FIGS. 3A and 3B a projection 42 projected toward the arm 21 is integrally projected from the upper end of the cam lever 40. A projection 43 projected rearwardly substantially in an L-shape is integrally projected from the upper end of the arm 21. The projection 42 is movably engaged with a recess 44 formed under the projection 43 so that the head pressure contacting plate 19 and the cam lever 40 can be moved only a distance A relative to each other. Distance A is determined by the rocking movement of projection 42 of the cam lever 40 within the recess 44 of the arm 21. A coiled spring for rotating the arm 21 clockwise, thereby energizing pressing plate 23 toward head pressure contacting lever 17, is interposed between the arm and the cam lever 40. When the groove cam 32 is further rotated by the motor 14 so that the cam follower 41 of the cam lever 40 is disposed at the ends of the main or sub cam grooves 37 or 39, the groove cam 32 is stopped due to an overload.

Figure 5:
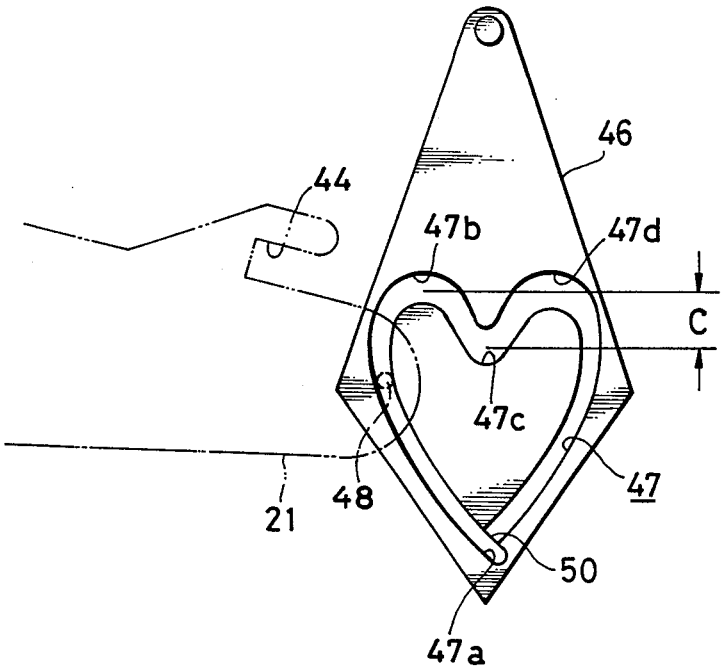
FIG. 5 is a front view showing in detail the cam groove of a heart cam.

A heart cam 46 in which a cam groove 47 formed substantially in a heart-shape as shown in FIG. 5, is rotatably supported at its upper end to the upper supporting shaft 30 which is supported to the bracket 29. A cam follower 48 projected from the arm 21 is engaged with the cam groove 47. The heart cam 46 is energized by the coiled spring 49 wound on the supporting shaft 30 so as to energize the cam follower 48 clockwise in the cam groove 47. The supporting shaft 30 is energized axially by spring 49 so as to effectively engage the cam follower 48 with the cam groove 47.

In the printing mode, the lower end 47*a* of the groove 47 engages the cam follower 48. In the head-up mode, the upper end 47*b* advanced clockwise from the printing position 47*a* engages the cam follower 48 and the thermal head 15 is separated from the platen 2. In the tape saving mode a recess 47*c* further advanced clockwise from the head-up position 47*b* engages the cam follower 48 and the thermal head 15 is separated from the platen 2, although the carriage 10 can move right. In the carriage return mode the upper end 47*d* further advanced clockwise from the tape saving position 47*c* engages the cam follower 48 and the thermal head 15 is separated from the platen 2 when feeding the sheet of paper and returning the carriage to its initial position.

The depth of the groove 47 is gradually reduced from the printing position 47*a* toward the carriage return position 47*d*. A step 50 is formed immediately before arriving at the printing position 47*a* and the printing position 47*a* is extended obliquely downward from the step 50 so as to effectively prevent the counter-clockwise movement of the cam follower 48.

The stroke B between the inner end 36 of the main cam groove 37 and the sub cam groove 39 is larger than the sum of the stroke A of the relative rotation between the arm 21 and the cam follower 41 and the stroke C of the arm 21 between the head up position 47*b* of the heart cam 46 and the tape saving position 47*c* ($B > A + C$). The coiled spring 45 is elongated when introducing the cam follower 41 disposed at the inner end 36 of the main cam groove 37 into the sub cam groove 39 in order to set the tape saving mode.

A photosensor 51 disposed between the toothed belt wheels 11C and 11D is mounted on the casing 1 and the carriage 10 is initialized by the photosensor 51 when a power source is applied or printing is begun. The photosensor 51 has a gate shaped frame 52, a light emitting element, and a photodetector, not shown, which are disposed at an interval in the frame 52. A shielding plate 53 for shielding light transmitted from the light emitting element to the photodetector when the thermal head 15 is in the printing mode is projected from the arm 22 into the frame 52 of the photosensor 51. Shielding plate 53 does not shield light from the photosensor during the carriage return mode A shielding plate 54 for shielding the light transmitted from the light emitting element to the photodetector when the carriage 10 is at its initial position is projected from the carriage 10.

The operation of the embodiment is described below.

When the power source is turned on or the printing is started, the carriage 10 is disposed at its initial, far-left position and the printing mode must be activated. To this end, the motor 14 is initially driven to move the carriage 10 a small distance to the right. When the carriage 10 is moved so that the light from the light emitting element of the photosensor 51 cannot be shielded by the shielding plate 54, light is transmitted to the photodetector and the position is registered.

The printing mode and the tape saving mode can be distinguished by the photosensor 51. When light reaches the photodetector, the printer is judged to be in the tape saving or carriage return mode, and when light is shielded from the photodetector by the shielding plate 53, the printer is judged to be in the printing mode.

During the printing mode the motor 14 is driven reversely twice in order to shift the printing mode to the carriage return mode. During the carriage return mode, the light from the light emitting element of the photosensor 51 is not shielded by the shielding plates 53 and 54, but is transmitted to the photodetector. Further, the cam follower 41 of the cam lever 40 is positioned at the inner end 36 of the cam groove 35 and the cam follower 48 of the arm 21 is positioned at the carriage return position 47*d* of the heart cam 46. Then, the motor 14 is rotated to return the carriage 10 to its initial position by moving it leftwards until the light from the light emitting element of the photosensor 51 is shielded by the shielding plate 54. During the movement of the carriage 10, the thermal head 15 is separated from the platen 2.

In FIG. 2, a ribbon cassette 55 is mounted on the carriage 10. The ribbon winding mechanism is disengaging when the head is separated from the platen, as is known in the art from U.S. Pat. No. 4,644,371, for example.

As described above, the motor 27 is driven to convey a sheet of paper by the conveying rollers 4 and the small rollers 8, and when paper is positioned on the rubber plate 3 of the platen 2, a print button is pressed. Then the motor 14 causes the clockwise rotation of the driving gear 13 in FIG. 2, thereby causing the clockwise rotation of the groove cam 32 in FIG. 4A. The cam follower 41 of the cam lever 40 positioned at the inner end 36 of the cam groove 35 is moved counter-clockwise along the cam groove 35 as the groove cam 32 is rotated. Because the cam lever 40 is energized clockwise in FIGS. 3A and 3B by the coiled springs 24 and 45, the cam follower 41 of the cam lever 40 is pressed radially outward along the cam groove 35, and the cam follower 41 moves to the outer end 38 along the main cam groove 37 without engaging the sub cam groove 39.

At this point, the cam follower 48 of the arm 21 is moved from the carriage return position 47*d* of the cam groove 47 of the heart cam 46 counter-clockwise toward the print position 47*a*. Thus, the head pressure contacting plate 19 is rotated clockwise in FIG. 3A which causes the clockwise rotation of the head pressure contacting plate 17 clockwise which moves the head mount 16., thereby contacting the thermal head 15, through the ink ribbon and the paper, with the rubber plate 3 of the platen 2. Thus, when the thermal head 15 contacts the rubber plate 3, the head pressure contacting lever 17 and the head pressure contacting plate 19 cannot rotate any further. The cam lever 40, however, is further rotated by the operation of the groove cam 32, thereby elongating the coiled spring 45 so that the strength of the spring 45 causes the thermal head 15 to apply pressure to the rubber plate 3. During this operation, the rotation of the motor 14 is prevented from being transmitted from the driving gear 13 to the toothed belt wheel 11A by the intermittent driving mechanism shown in FIG. 6. Therefore, the toothed belt 12 is not fed, and the carriage 10 does not move.

When the motor 14 is further rotated in the same direction, the rotation of the motor 14 is transmitted through the intermittent driving mechanism to the toothed belt wheel 11A. Toothed belt wheel 11A thereby feeds the toothed belt 12 rightward in FIG. 2 and causes the movement of carriage 10. The ink of the ink ribbon is transferred at each character position by the heat of the thermal head 15 to the paper. When the printing of one line is finished the carriage return mode is activated. The motor 14 is reversely rotated, causing the driving gear 13 to rotate counter-clockwise so that the groove cam 32 also starts rotating counter-clockwise in FIG. 4A. The cam follower 41 of the cam lever 40 positioned at the outer end 38 of the main cam groove 37 moves relatively clockwise until it stops at the inner end 36.

At this time the cam follower 48 of the arm 21 is moved from the printing position 47*a* of the cam groove 47 to the carriage return position 47*d*. Thus, the head pressure contacting plate 19 is rotated counter-clockwise in FIG. 3B so that the pressing plate 23 is separated from the head pressure contacting lever 17 which then rotates counter-clockwise by its own weight, and the thermal head 15 is separated from the rubber plate 3.

When the motor 14 is further rotated in the same direction, the rotation of the motor 14 is transmitted through the intermittent driving mechanism to the toothed belt wheel 11A to start feeding the toothed belt 12, thereby moving carriage 10 leftward in FIG. 2, and performing the carriage return. During the carriage return a motor 27 feeds the paper a predetermined amount. When the carriage 10 is returned to the left end of the casing 1 so that the light from the light emitting element is shielded from photodetector by the shielding plate 54, the motor 14 is reversely rotated.

To activate the tape saving mode from the carriage return mode, the driving gear 13 is again rotated clockwise so that the groove cam 32 starts rotating clockwise in FIG. 4A which forces the cam follower 41 of the cam lever 40 positioned at the inner end 36 of the cam groove 35 to move counter-clockwise relative to the groove cam 32. But the cam follower 48 of the arm 21 rotating together with the cam lever 40 is moved only from the head up position 47*b* to the tape saving position of 47*c* in the cam groove 47 of the heart cam 46. Thus the cam lever 40 which tends to move farther by the movement of the cam follower 41 in the cam groove 35 ($B>A+C$) is rotated clockwise in FIG. 3B, thereby elongating the coiled spring 45. The counter-clockwise rotating force is opposed by the spring force of the elongated coil 45. The cam follower 41 of the cam lever 40 is pressed radially inward in the cam groove 35 of the groove cam 32 thereby introducing the cam follower 41 to the sub cam groove 39 and activating the tape saving mode.

To switch from the tape saving mode to the printing mode, the motor 14 is first reversely rotated to position the cam follower 41 at the inner end 36 of the cam groove 35 and the cam follower 48 of the arm 21 is moved from the tape saving position 47*c* of the cam groove 47 to the carriage return position 47*d*. The motor 14 is rotated in the opposite direction to actuate the printing mode and contact the thermal head 15 with the rubber plate 3, and the above described operation is similarly executed to print the type.

When a large space exists in image formation, in order to eliminate waste of the ink ribbon the tape saving mode must be set. To this end, the CPU (not shown) of the thermal printer detects he large space in the image information and sets the tape saving mode so that the motor 14, when already in the printing mode, is reversely rotated. Then in a manner similar to the initialization described above, the cam follower 41 of the cam lever 40 moves from the outer end 38 to the inner end 36 of the cam groove 35 and the cam follower 48 of the arm 21 is moved from the printing position 47*a* to the head up position 47*b*. Due to the operation of the intermittent driving mechanism, the carriage 10 does not start moving, however, and the motor 14 is rotated in the opposite direction as described above. When the cam follower 41 of the cam lever 40 is moved from the inner end 36 to the outside of the cam groove 35, the cam follower 48 is moved from the head up position 47*b* to the tape saving position 47*c* in the cam groove 47. In this way the cam follower 41 of the cam lever 40 is introduced to the sub cam groove 39 by the spring force of the coiled spring 45 in order to set the tape saving mode which will separate the thermal head 15 from the rubber plate 3. Therefore, in this tape saving mode, the carriage 10 is moved left to right in FIG. 2 similarly to the printing mode, but the thermal head 15 is separated from the rubber plate 3 of the platen 2 as described above for the carriage return mode. Thus, the ink ribbon interposed therebetween is not fed, and the ink ribbon is not wasted.

When the tape saving mode is switched to the printing mode by a command from the CPU, the motor 14 is rotated twice in two opposite directions as described above, thereby setting the printing mode through the carriage return mode.

According to this embodiment the tape saving mode which prevents waste of the ink ribbon is performed with a relatively simple, inexpensive construction without using an expensive component, such as a solenoid. Further, the carriage 10 and the head pressure contacting plate 19 can be stably initialized by the sole photosensor 51, thereby avoiding irregular printing positions. Moreover, since the pressure contacting force of the thermal head 15 with the rubber plate 3 is augmented by a coiled spring 24, the load of the motor 14 can be reduced.

The present invention is not limited to the particular embodiment. Various other changes and modifications may be made within the spirit and the scope of the present invention. According to this invention as described above, the cam engaged with the cam follower of the cam lever is reversely rotated twice in order to operate the heart cam engaged with the cam follower of the head pressure contacting plate. Simple and stable switching of the printing mode and the tape saving mode by the operation of the heart cam engaged with the cam follower makes possible a simple, inexpensively produced structure.

What is claimed is:

1. A head position controller for a thermal printer which includes a thermal head, a platen, and a carriage which is supported for movement relative to the platen by a reversible motor, the head position controller comprising:

a head pressure contacting plate for moving the thermal head into separating and contacting positions relative to the platen, a first cam rotated by the motor which effects movement of the pressure contacting plate, the first cam having a first cam curve which is shaped to selectively move the thermal head with respect to the platen from the separating position to the contacting position, a cam lever having a first cam follower moveable along the first cam curve upon rotation of the first cam by the motor, the cam lever being connected to the head pressure contacting plate for movement only at a predetermined angle, a second cam having a second cam curve provided to define rotation of the cam lever, the second cam curve being engaged with a second cam follower which projects from the head pressure contacting plate, and an intermittent driving mechanism driven by the motor for transmitting intermittent movement to the carriage only after the motor rotates a predetermined distance.

2. A head position controller for a thermal printer according to claim 1, wherein:

a spring member for energizing said head pressure contacting plate and said cam lever towards each other is interposed therebetween, a second spring member for energizing said thermal head in a direction for contacting said thermal head to said platen is attached to said head pressure contacting plate, and the second cam curve of the second cam is substantially heart shaped.

3. A head position controller for a thermal printer according to claim 1, further comprising means for activating three modes of operation, said modes being:

a printing mode in which the thermal head contacts the platen and the carriage moves in a direction for printing, a carriage return mode in which the thermal head is separated from the platen and the carriage moves opposite the direction for printing, and a tape saving mode in which the thermal head is separated from the platen and the carriage moves in the direction for printing, the means for activating include the first cam, the second cam and the cam lever.

* * * * *